United States Patent [19]

Seto

[11] Patent Number: 4,868,898

[45] Date of Patent: Sep. 19, 1989

[54] ELECTRICALLY HEATED PORTABLE SEAT

[76] Inventor: Hiroshi Seto, 549 Enterprise Dr., Rohnert Park, Calif. 94928

[21] Appl. No.: 231,480

[22] Filed: Aug. 12, 1988

[51] Int. Cl.[4] ..... H05B 3/54; H05B 1/02; A47C 7/18

[52] U.S. Cl. ..... 219/528; 219/217; 219/527; 219/530; 219/533; 219/549; 128/403

[58] Field of Search ..... 219/212, 211, 217, 345, 219/522, 528, 529, 545, 549, 527, 327, 328; 128/376, 377, 399, 400, 402, 403

[56] References Cited

U.S. PATENT DOCUMENTS

| | | | |
|---|---|---|---|
| 2,185,692 | 1/1940 | McCleary | 219/217 |
| 2,198,989 | 4/1940 | Cooley | 128/254 |
| 2,294,010 | 8/1942 | Daam | 219/217 |
| 2,584,302 | 2/1952 | Stein | 219/217 |
| 3,014,117 | 1/1961 | Madding | 219/217 |
| 3,017,493 | 1/1962 | Cooke | 219/217 |
| 3,255,337 | 6/1966 | Willat | 219/528 |
| 3,780,262 | 12/1973 | Rudd | 219/341 |
| 4,423,308 | 12/1983 | Callaway | 219/217 |
| 4,561,441 | 12/1985 | Kolodziej | 128/403 |
| 4,777,346 | 10/1988 | Swanton | 219/313 |

*Primary Examiner*—A. D. Pellinen
*Assistant Examiner*—Leon K. Fuller

[57] ABSTRACT

An electrically heated portable seat for automobiles includes a flexible and liquid-impervious container having spaced top and bottom surfaces, a sponge-like material bonded to the inner surface of the container, a liquid absorbed in the sponge-like material, and an electrical heating element for heating the liquid inside of the container. The seat is plugged into a wall outlet in a house just before its use. After the seat is warmed up, it is carried to a car and placed on the car seat.

4 Claims, 1 Drawing Sheet

ELECTRICALLY HEATED PORTABLE SEAT

FIELD OF INVENTION

This invention relates to an electrically heated portable seat for automobiles, and in particular to a portable seat which retains heat after being disconnected from an electric power source.

DESCRIPTION OF PRIOR ART

The cold weather, it is very uncomfortable to sit on a vinyl seat of a car that has been parked outside for a long period, because the vinyl seat has an extremely cold touch. In order to solve this problem, some cars are equipped with heated seats which utilize car batteries as an energy source of the heat. This solution creates another problem. Because it takes time for the seat to warm up, a person has to wait outside of the car until the seat gets warm. If it is snowing or raining outside, the person has no choice but to sit on the seat regardless of its coldness.

Portable pads, which contain water or other liquid and an electrical heater, have been proposed mainly for patient treatment (U.S. Pat. No. 3,014,117, U.S. Pat. No. 4,561,441). One might suggest converting these pads to an automobile seat. However, since these pads are not particularly designed for a portable seat for automobiles, such conversion creates some problems. For example, the mat by Madding simply contains water in a flexible container. When a person carries this mat, the mat will assume a balloon-like shape due to the weight of the water. In addition, while the mat is being carried around, the water sloshes inside of the mat making it difficult to carry. Kolodziej's mat has collapsible perforated ribs and sponge-like bars to prevent water from sloshing, but the structure is so complicated that it is not easy to manufacture.

OBJECTS AND ADVANTAGES OF THE INVENTION

One of the objects of this invention is to provide a portable heated seat which retains heat after being disconnected from an electric power source.

Another object of this invention is to provide a seat which minimizes the liquid sloshing problem inside of the seat while being carried.

A further object of this invention is to provide a seat which is simple in structure and easy to manufacture.

Additional objects and advantages will be shown in the following description and the drawings.

DETAILED DESCRIPTION OF THE INVENTION

Figure 1:
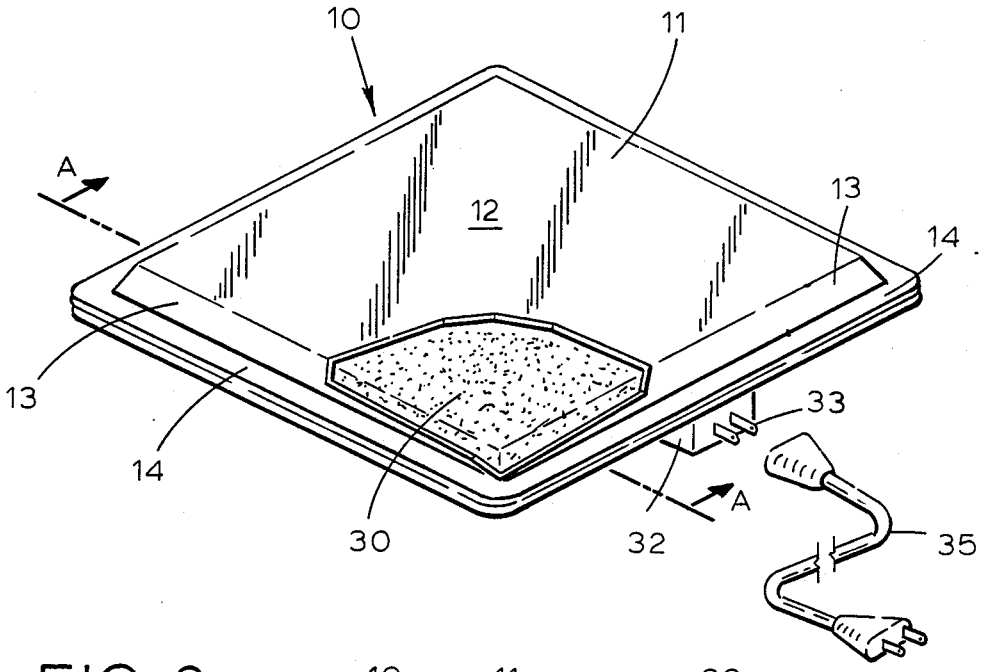
FIG. 1 shows a perspective cutaway view of the portable seat.
Figure 2:
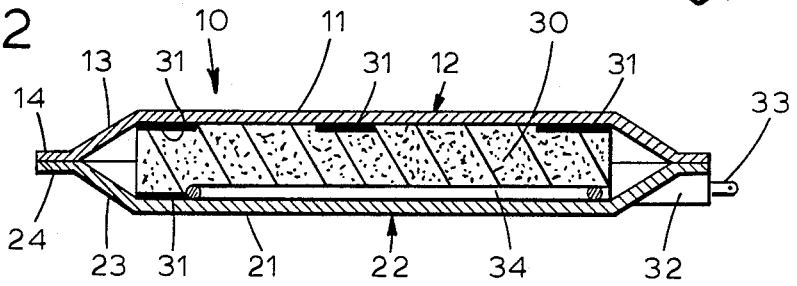
FIG. 2 shows a cross sectional view taken approximately along A—A line of FIG. 1 and looking in the direction of the arrows.

Referring to FIG. 1 and FIG. 2, a portable set 10 includes a top plastic cover 11 and a bottom plastic cover 21 which together form a container, a rectangular-shape foam or sponge-like material 30 and an electrical heating element 34 inside of the container. The top cover 11 and the bottom cover 21 are of flexible material that is imprevious to liquid, and may be made of polyethylene film or the like. A flat surface 12 of the top cover 11 and a flat surface 22 of the bottom cover 21 form two parallel faces. Each cover 11 and 21 also includes tapered surfaces 13 and 23 at the peripherals of the flat surfaces 12 and 22, enclosing the volume defined between the flat surfaces 12 and 22. Outer edges of the cover 11 and 21 have flanges 14 and 24. These flanges 14 and 24 are liquid-impreviously sealed by an adhesive or heat treatment, or other proper methods. Inner surfaces of the cover 11 and 12, and outer surfaces of the sponge 30 are at least partially attached together by an adhesive or other proper methods as indicated by a numeral 31, securing the sponge 30 into place. The seat 10 is best partially filled with water, salt water, or other liquid which retains heat. Being filled partially, the pressure build-up inside of the container will be reduced when a person sits on the seat, preventing the possible rupture of the container. When the pressure build-up is reduced, the thickness of the cover material can be thin. The water in the seat 10 is mostly absorbed in the sponge 30.

A plastic casing 32, which contains a standard electrical plug 33 and a temperature control device (not shown) for the insulated electrical heating element 34, is installed at an opening created at the tapered surface 23 of the bottom cover 21. The edges at which the casing 32 and covers 11 and 21 meet are properly sealed in order to prevent the water inside from leaking out. The temperature control device maintains the temperature in a safe range. The heating element 34 is of an electrical resistance and is water immersible such as the one shown in U.S. Pat. No. 4,242,573. Desirably, the heating element is flexible and thin such as the one shown in U.S. Pat. No. 3,584,198. The heating element 34 is placed between the sponge 30 and the bottom cover 21 in order to transfer the heat to the water absorbed in the sponge 30.

A person who wants to use this seat, first plugs it into an electric power outlet in his (her) house or office. The plug 33 can be plugged into the outlet, or, if necessary, an extension power cord 35 may be used. Several minutes later, the water absorbed in the sponge 30 will be heated up to a desirable temperature. The temperature control device will regulate the temperature within a safe range so that the person can touch the seat 10 safely. Next the person disconnects the seat 10 from the wall outlet, and carries it to his (her) car parked outside of the house. While the seat 10 is being carried, the water does not slosh inside of the seat 10 because most of the water is absorbed in the sponge 30 and retained. Even if the seat 10 is being carried vertically, the sponge 30 does not sag into the bottom of the seat 10 despite the weight of the water it absorbed, because the portion 31 of the sponge 30 is attached to the inner surface of the cover 11 and 21, and is being held at that position. Next, the person opens the car door, and places the seat 10 on the car seat. Even though a couple of minutes might pass after the seat 10 is disconnected from the power outlet, the seat 10 is still warm because the water inside retains heat for a while. Without waiting, the person can sit on the seat 10 comfortably and can close the car door. By using this portable seat 10, the person need not to wait until the car seat warms up even if his (her) car is equipped with a heated car seat. If his (her) car is not equipped with a heated seat, this portable seat is quite beneficial in winter time or in a cold climate.

Figure 3:
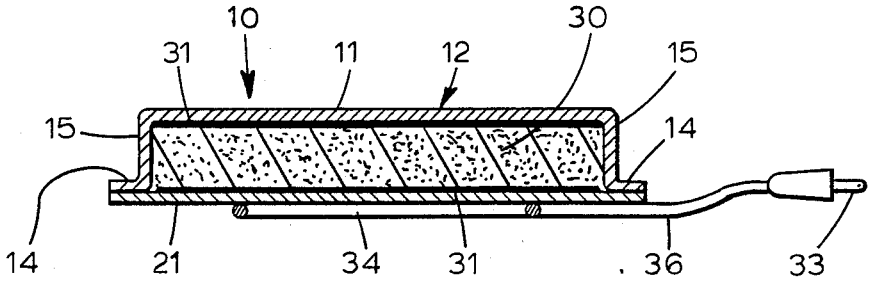
FIG. 3 shows a cross sectional view of another embodiment of the invention.

FIG. 3 shows another embodiment. A portable seat 10 includes a top cover 11, water-absorbed sponge 30, a flat bottom cover 21, and an electrical heating element 34 underneath the bottom cover 21. The top cover 11 has a flat surface 12, vertical walls 15 at the peripherals of the surface 12, and flanges 14 at the edges of the walls 15. These flanges 14 and the edges of the bottom cover 21 are liquid-imperviously sealed. An entire top surface of the sponge 30 is attached to an entire inner surface of the flat surface 12 as indicated by numeral 31. Similarly, an entire bottom surface of the sponge 30 is attached to an entire inner surface of the bottom cover 21. This way, the sponge 30 is firmly held in its position minimizing the possibility of the sponge's peeling off from the covers 11 and 21. Since the electrical heating element 34 is secured outside of the container, the element 34 need not to be waterproof. An ordinary heating element can be used as long as it is electrically insulated. The element 34 is attached to a power cord 36 and a plug 33.

The scope of the invention should not be limited to the examples mentioned above. The shapes of the covers and the sponges can be changed: the covers can have a corrugated surface, or a curved surface instead of the flat surface, for example. The location of the heating element can be anywhere: the element can be embedded inside of the sponge, for example. The container can be fully filled with liquid. Also the container can have a cap in order to replace the liquid inside.

I claim:

1. A portable seat comprising, a flexible and liquid-impervious container having spaced top and bottom surfaces, a sponge-like material in the container, bonding means for creating permanent bond between the outer surface of the sponge-like material and the inner surface of the container, a liquid absorbed in the sponge-like material, and an electrical heating element for heating the liquid inside of the container.

2. The portable seat of claim 1 wherein at least a portion of the outer surface of the sponge-like material is bonded to the inner surface of the container.

3. The portable seat of claim 1 wherein the heating element has a temperature control device.

4. The portable seat of claim 1 wherein the container is partially filled with liquid.

* * * * *